US005813642A

United States Patent [19]

Warren

[11] Patent Number: 5,813,642

[45] Date of Patent: Sep. 29, 1998

[54] TOMBSTONE MEMORIAL PLAQUE AND SUPPORT BRACKET ASSEMBLY

[76] Inventor: David O. Warren, 4302 Ballantine Rd., Dewitt, Mich. 48820

[21] Appl. No.: 716,475

[22] Filed: Sep. 19, 1996

[51] Int. Cl.[6] ..... A47B 96/06

[52] U.S. Cl. ..... 248/229.15

[58] Field of Search ..... 248/231.71, 229.15, 248/229.25, 228.6; 40/124.5

[56] References Cited

U.S. PATENT DOCUMENTS 3,570,159 3/1971 Burgener, Jr. et al. ..... 40/124.5

5,388,359 2/1995 DeWitt ..... 248/231.71 X

*Primary Examiner*—Ramon O. Ramirez

*Attorney, Agent, or Firm*—Miller, Morriss & Pappas

[57] ABSTRACT

A support bracket adapted to support a plaque above a tombstone. The bracket having a slot across its uppermost portion for receiving the plaque and a screw extending perpendicular through the slot for securing the plaque. The bracket further having downwardly extending flanges adapted to contact the sides of the tombstone, with at least one of the flanges having a recess for receiving a screw for securing the bracket to the sides of the tombstone.

3 Claims, 5 Drawing Sheets

TOMBSTONE MEMORIAL PLAQUE AND SUPPORT BRACKET ASSEMBLY

This invention relates to a contoured tombstone engaging support bracket assembly which is adapted to selectively supportably engage and retain a selectively personalized memorial display plaque in a display position above a tombstone.

This invention also relates to a contoured tombstone engaging support bracket assembly which is provided with a transversely positioned memorial display plaque receiving slot across the uppermost portion thereof so as to supportably engage and retain a memorial display plaque therein in a spaced apart position above and in parallel register with the tombstone upon which the contoured support bracket is mounted.

Further, this invention also relates to a contoured tombstone engaging support bracket assembly having downwardly extending contoured tombstone engaging flange portions at each end thereof which are adapted to matingly engage the upper front and rear wall portions of a tombstone.

This invention also relates to a contoured tombstone engaging support bracket assembly provided with memorial display plaque recessed retainer screw means to retainably engage a memorial display plaque selectively positioned within the memorial display plaque engaging slot provided transversely across the upper portion of the contoured support bracket.

This invention also relates to a contoured tombstone engaging support bracket assembly provided with recessed tombstone engaging retainer screw means to retainably engage the upper portion of a tombstone upon which the contoured tombstone engaging support bracket assembly is mounted.

This invention, in its preferred embodiment, also relates to a memorial display plaque retainer screw means and tombstone engaging retainer screw means which are operably positioned within threaded recesses provided within the contoured tombstone engaging support bracket assembly.

This invention also relates to several modifications which have angular tombstone engaging support bracket assemblies which are adapted to supportably engage and retain a personalized memorial display plaque in a display position above a tombstone.

It is, therefore, an object of this invention to provide a unique tombstone engaging support bracket assembly which is adapted to be easily and quickly mounted on a tombstone so as to supportably engage and retain a memorial display plaque in a spaced apart display position above and in parallel register with the tombstone upon which the support bracket assembly is mounted.

Other objects and advantages found in the construction of the invention will be apparent from a consideration in connection with the appended claims and the accompanying drawings.

IN THE DRAWINGS

DESCRIPTION

Figure 1:
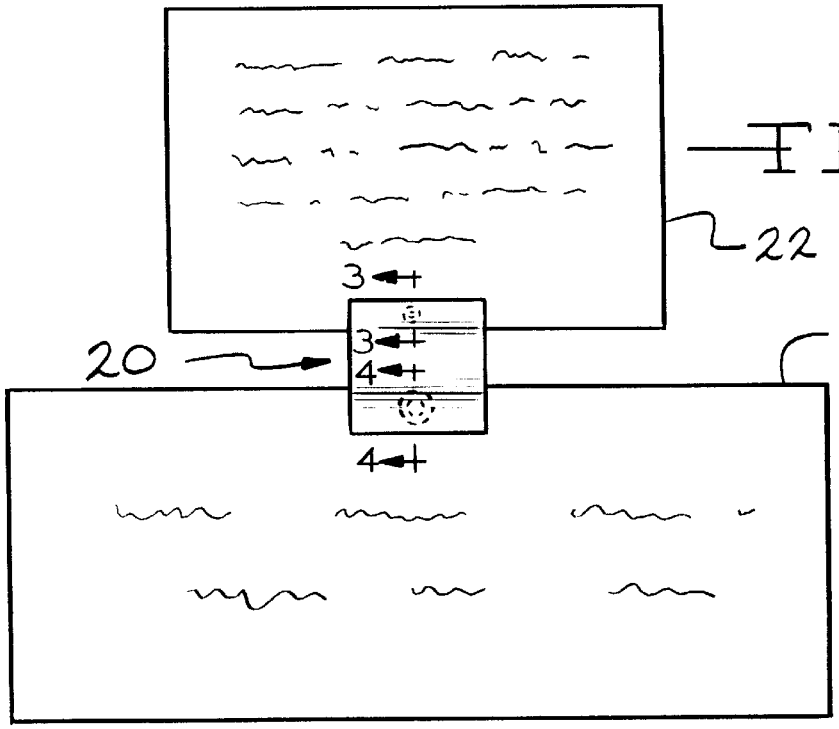
FIG. 1 is a schematic front elevational view showing the tombstone engaging support bracket assembly in its operational use position on a tombstone with a memorial display plaque positioned thereon.

As shown in the schematic front elevational view of FIG. 1, the preferred embodiment of the tombstone memorial plaque and support bracket assembly 20 is shown in its operational use position selectively clamped across the upper portion of a tombstone 21. A tombstone memorial display plaque 22 is selectively clampably mounted on the upper portion of the support bracket assembly 20. The memorial display plaque 22 is thus fixedly supported in its operational use position above the tombstone in a parallel aligned register therewith.

While the memorial display plaque 22 is shown in a flat rectangular configuration, it can be of a round, oval or any other desired configuration as long as it is adapted to engage the memorial display plaque retainer slot 23 provided transversely across the upper portion of the tombstone support bracket assembly 20 as will be hereinafter described. Further, the memorial display plaque can selectively display prose, poetry, appropriate decorative design and/or a photograph of the deceased.

Figure 2:
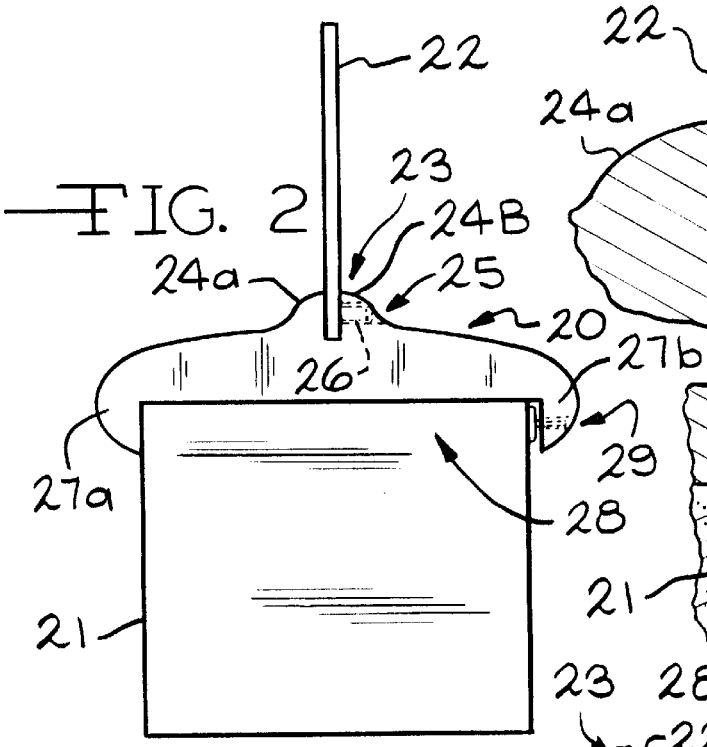
FIG. 2 is a schematic right side elevational view of the tombstone engaging support bracket assembly as shown in FIG. 1.
Figure 3:
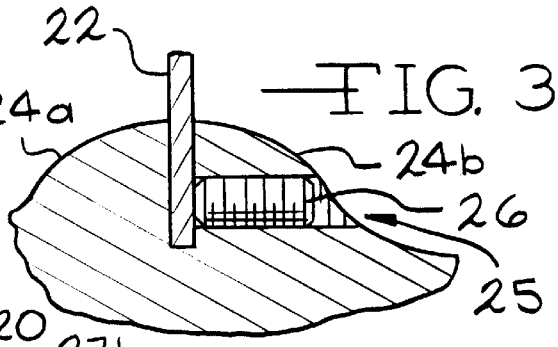
FIG. 3 is a partial enlarged schematic cross-sectional side view showing the recessed memorial plaque retainer screw in its operative use against the memorial display plaque.

As shown in the schematic right side elevational view of FIG. 2 and the enlarged partial cross-sectional view of FIG. 3 taken on line 3—3 of FIG. 1, the tombstone engaging support bracket assembly 20 has a contoured configuration which includes upper transversely oriented centrally positioned front and rear raised portions 24*a* and 24*b* respectively which coact to define the transversely oriented memorial display plaque receiving slot 23 therebetween.

A threaded recessed memorial display plaque retainer screw hole 25 is provided through the rear raised portion 24*b*. The threaded screw hole 25 is adapted to operably receive a memorial display plaque retainer screw 26 therethrough. The memorial display plaque retainer screw 26 can be selectively advanced to retainably engage the lower portion of the memorial display plaque 22 selectively positioned within the memorial display plaque receiving slot 23. The retainer screw 26 can be selectively unscrewed to disengage the memorial display plaque 22 so as to permit removal of the display plaque 22, as desired.

Figure 4:
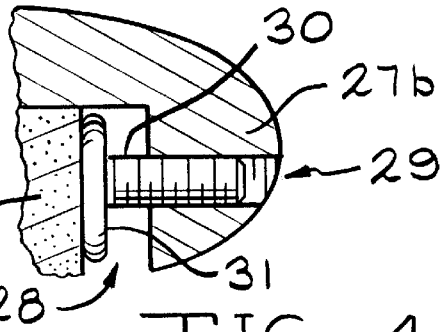
FIG. 4 is a partial schematic cross-sectional side view of a modified tombstone engaging retainer screw.

As further shown in FIG. 2 and the enlarged partial cross-sectional view of FIG. 4 taken on line 4—4 of FIG. 1, the tombstone engaging support bracket assembly 20 is provided with downwardly extending spaced apart tombstone engaging front and rear portions, 27*a* and 27*b*, respectively. The spaced apart, downwardly extending tombstone engaging front and rear portions 27*a* and 27*b*, respectively, coact to define a tombstone engaging recess 28 which is adapted to engage the upper portion of the tombstone 21.

A threaded recessed tombstone retainer screw hole 29 is provided through the downwardly extending tombstone rear portion 27*b*. The tombstone retainer screw hole 29 is adapted to operably receive a tombstone engaging retainer screw 30 so as to selectively be advanced to engage the upper rear wall of the tombstone 21. The tombstone engaging retainer screw 30, as shown in FIG. 4, is provided with a flat tombstone wall engaging flange 31 which is adapted to engage the tombstone wall to compensate for a tombstone which is narrower than the distance between the downwardly extending front and rear portions, 27*a* and 27*b*, of the support bracket assembly. If the tombstone width fits snugly between the front and rear portions 27*a* and 27*b*, a regular retainer set screw can be used.

Figure 5:
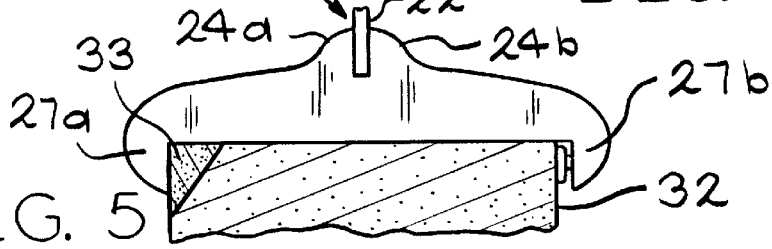
FIG. 5 is a schematic side elevational view showing the use of a shim member to compensate for an irregularly shaped tombstone.

As shown in the cross-sectional schematic view of FIG. 5, the tombstone support bracket assembly 20 can be selectively positioned on a tombstone 32 having an irregularly shaped upper portion. A stone shim member 33 can be selectively configured to matingly engage the irregular portion of the tombstone so as to achieve a substantially rectangular tombstone upper portion upon which the tombstone support bracket assembly 20 can be mounted.

While the preferred embodiment of the tombstone support bracket assembly 20 has a contoured overall configuration as shown in FIGS. 1 through 5, it is within the scope of this invention to provide a modified embodiment of a tombstone support bracket assembly 34 which has a substantially angular configuration.

Figure 6:
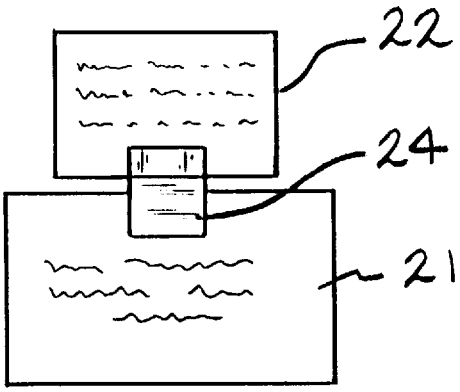
FIG. 6 is a schematic front elevational view showing a modified embodiment of the tombstone engaging support bracket assembly.

The front elevational view of FIG. 6 shows the modified tombstone support bracket assembly 34 in its operational use position mounted on a tombstone 21 and supporting a memorial display plaque 22 in a spaced apart parallel aligned register above the tombstone 21.

Figure 7:
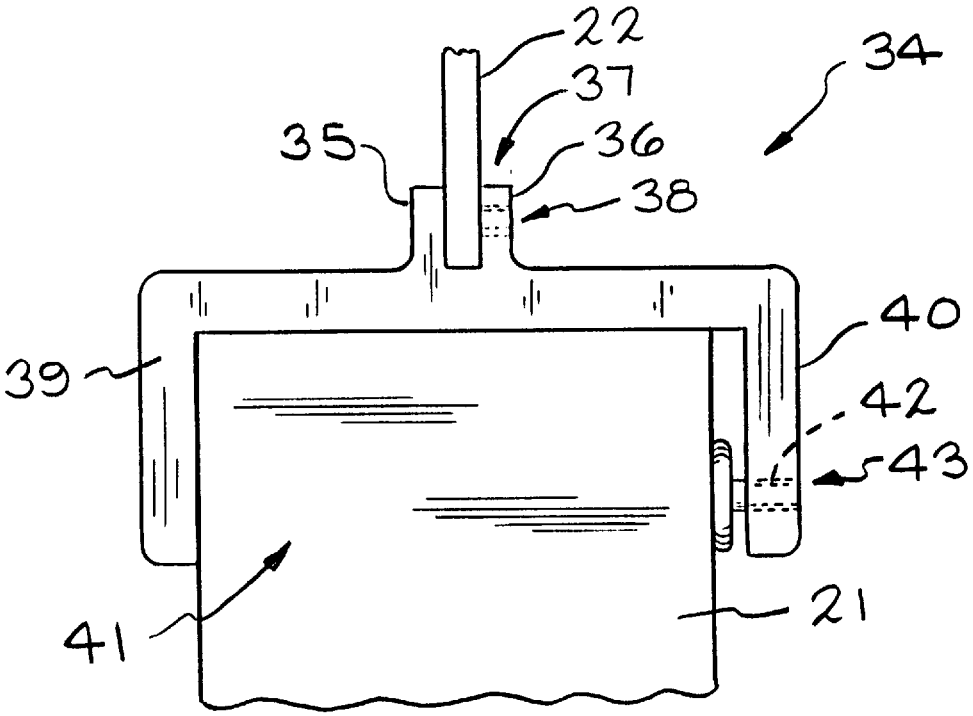
FIG. 7 is a schematic right side elevational view showing a first modified embodiment of the tombstone engaging support bracket assembly shown in FIG. 6.

As shown in FIG. 7, the modified tombstone support bracket assembly 34 is provided with spaced apart upwardly extending front and rear memorial plaque engaging flanges 35 and 36, respectively, which cooperate to define a memorial display plaque receiving slot 37 which is adapted to selectively receive and retain a memorial display plaque 22 therein. The rear memorial plaque engaging flange 36 is provided with a threaded set screw receiving hole 38 so as to selectively receive a memorial plaque engaging screw 26 therethrough which retainably engages a memorial plaque 22 positioned in the slot 37.

The modified tombstone support bracket assembly 34 is also provided with spaced apart downwardly extending front and rear tombstone engaging portions 39 and 40, respectively, which coact to define a tombstone engaging recess 41 which is adapted to selectively engage the upper portion of a tombstone 21 and be retained thereon by a retainer screw 42 positioned within the threaded retainer screw opening 43 through the rear tombstone engaging flange 39. In all other respects, the modified tombstone support bracket assembly 34 operates in the same manner as the preferred embodiment tombstone support bracket assembly 20.

Figure 8:
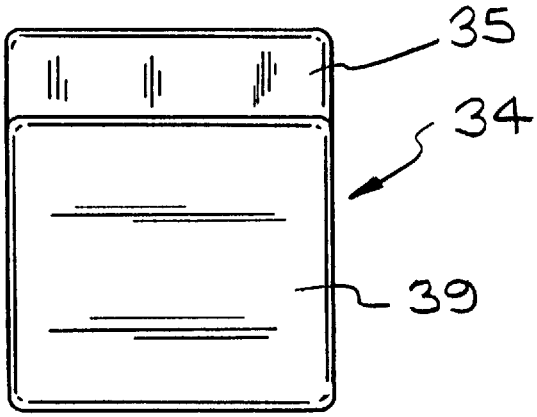
FIG. 8 is a schematic front elevational view of the first modified tombstone engaging support bracket assembly shown in FIGS. 6 and 7.

As further shown in the front elevational view of FIG. 8, the first modified tombstone support bracket 34 (shown in FIGS. 6 and 7) is provided with an upwardly extending front memorial display plaque engaging flange 35 and a front downwardly extending tombstone engaging portion 39.

Figure 9:
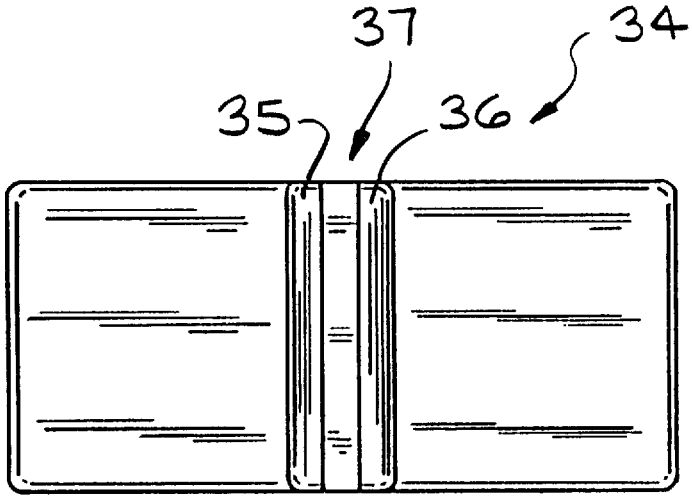
FIG. 9 is a schematic top view of the modified tombstone engaging support bracket assembly shown in FIGS. 6, 7 and 8.

As further shown in the top view of FIG. 9, the first modified tombstone support bracket 34 (shown in FIGS. 6, 7 and 8) is provided with a front upwardly extending memorial display plaque engaging flange 35 and a rear upwardly extending memorial display plaque engaging flange 36 which cooperates with the front memorial display plaque engaging flange 35 so as to define a memorial display plaque engaging slot 37 there-between.

Figure 10:
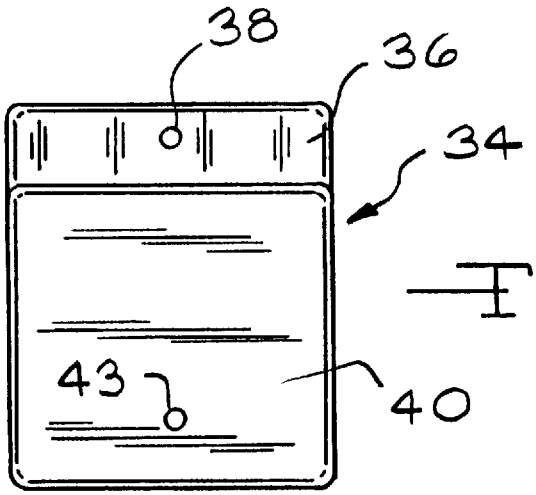
FIG. 10 is a schematic rear elevational view of the tombstone engaging support bracket assembly shown in FIGS. 6, 7, 8 and 9.

As further shown in the rear elevational view of FIG. 10, the first modified tombstone support bracket 34 includes a rear upwardly extending flange 36 and a rear downwardly extending tombstone engaging portion 40. As previously discussed, the upwardly extending rear flange 36 is provided with a threaded memorial display plaque set screw retainer hole 38 therethrough and the downwardly extending rear tombstone engaging portion 40 is provided with a threaded tombstone engaging set screw retainer hole 43 therethrough.

Figure 11:
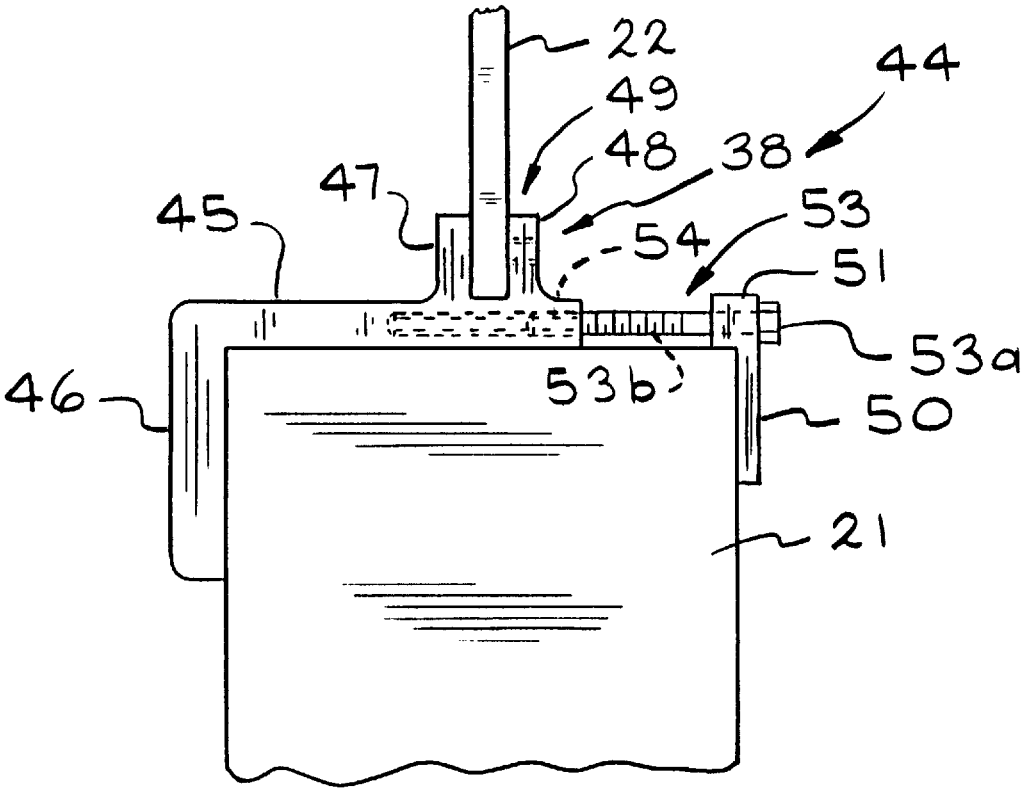
FIG. 11 is a schematic right side elevational view showing a second modified embodiment of the tombstone engaging support bracket assembly.

As shown in side elevational view FIG. 11, another embodiment of the tombstone engaging support bracket assembly is provided so as to be selectively mountable upon a tombstone which is of an above-standard thickness.

The modified tombstone engaging support bracket assembly 44 is comprised of a front main body portion 45 having a front downwardly extending tombstone engaging portion 46. The main body portion 45 is also provided with spaced apart upwardly extending front and rear memorial display plaque engaging flanges 47 and 48, respectively, which cooperate to define a memorial display plaque receiving slot 49 therebetween which is adapted to selectively receive and retain a memorial display plaque 22 therein. A separate rear downwardly extending tombstone engaging portion 50 having an inward horizontally extending tombstone engaging flange 51 which is adapted to rest upon the upper surface of a tombstone 21 in spaced-apart aligned register with the main body portion 45.

The tombstone engaging flange portion 51 is provided with a connector bolt stem receiving hole 52 therethrough. A threaded connector bolt 53 is provided with a large head 53*a* which operably engages the outer portion of the flange 51 provided on the rear tombstone engaging portion 50. The threaded connector bolt 53 is provided with a threaded stem 53*b* which is adapted to freely pass through the connector bolt stem receiving hole 52 into operative engagement with a threaded connector bolt stem receiving hole 54 provided in the main body portion 45. The threaded bolt stem 53*b* is adapted to be selectively screwed into the threaded bolt stem receiving hole 54 so as to coact with the front tombstone engaging portion 45 whereby the front tombstone engaging portion 46 and the rear tombstone engaging portion 50 clampably engage the tombstone 21 therebetween.

Figure 12:
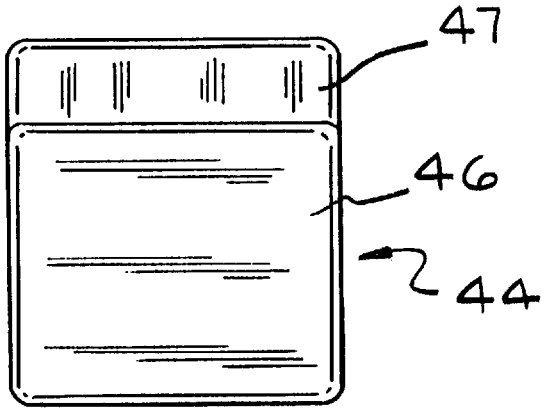
FIG. 12 is a schematic front elevational view of the second modified embodiment of the tombstone engaging support bracket assembly shown in FIG. 11.
Figure 13:
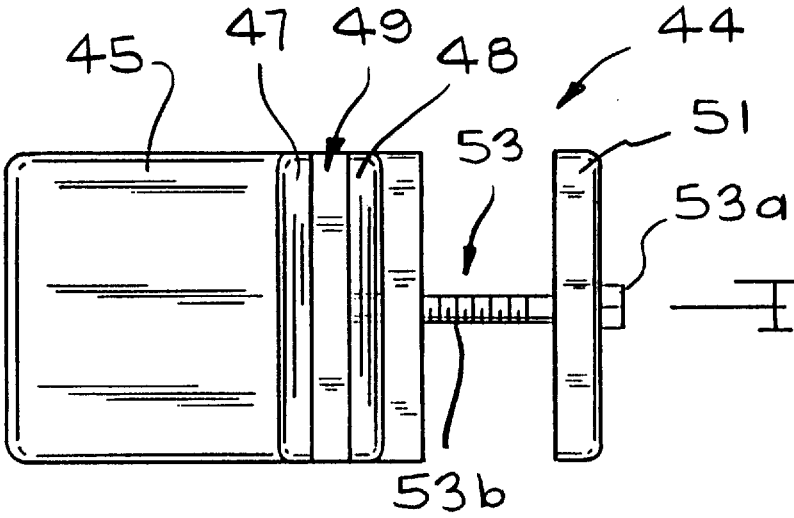
FIG. 13 is a schematic top view of the tombstone engaging support bracket assembly shown in FIGS. 11 and 12.
Figure 14:
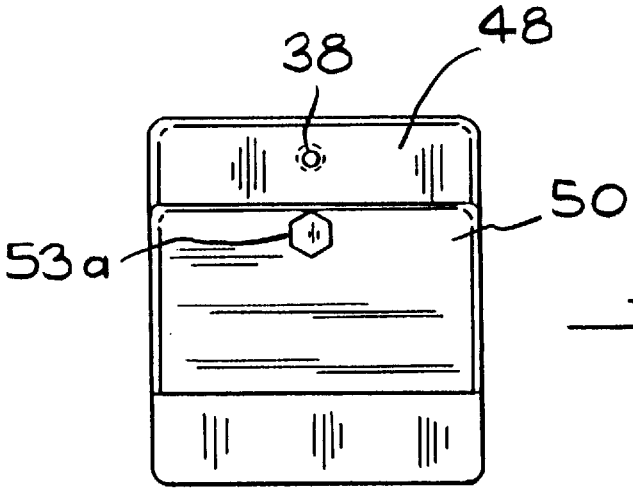
FIG. 14 is a schematic rear elevational view of the engaging bracket assembly shown in FIGS. 11, 12 and 13.

The front elevational view of FIG. 12, the top view of FIG. 13 and the rear view of FIG. 14 show the modified tombstone support bracket assembly 44 (see FIG. 11) as previously discussed in greater detail and will not be repeated at this point except to state that the upwardly extending memorial display plaque flanges 47 and 48 are transversely coextensive with the main body portion 45. The same is true with the downwardly extending front tombstone engaging portion 46 and the separate rear tombstone engaging portion 50.

In summary, a contoured tombstone engaging support bracket assembly is provided for supporting a personalized memorial display plaque in a display position above and in parallel register with a tombstone.

The contoured tombstone engaging support bracket assembly is provided with a front contoured downwardly extending tombstone engaging portion. The contoured tombstone engaging support bracket assembly is also provided with a rear contoured downwardly extending tombstone engaging portion in spaced-apart parallel register with the front contoured downwardly extending tombstone engaging portion so as to cooperate therewith to define a tombstone engaging recess therebetween. The rear contoured downwardly extending tombstone engaging portion is provided with a recessed threaded tombstone retainer screw hole longitudinal therethrough. The recessed tombstone retainer screw hole is operably provided with a tombstone engaging retainer screw therethrough to selectively retainably engage the upper portion of a tombstone positioned within the tombstone engaging recess so as to secure the contoured tombstone support bracket assembly in its operative use position across the top of the tombstone upon which it is mounted. The contoured tombstone engaging support bracket assembly is provided with a centrally positioned forward contoured upper raised portion. The contoured tombstone engaging support bracket assembly is also provided with a centrally positioned rear contoured upper raised portion in spaced-apart parallel register with the forward contoured upper raised portion so as to cooperate therewith to define a transverse memorial display plaque engaging slot therebetween. The centrally positioned rear contoured upper raised portion is provided with a recessed memorial display plaque retainer screw hole longitudinally therethrough. The recessed memorial display plaque retainer screw hole is operably provided with a memorial display plaque retainer screw therethrough to selectively retainably engage the lower portion of a memorial display plaque selectively positioned within said transverse memorial display plaque engaging slot so as to secure the memorial display plaque in its operative use display position upon said contoured tombstone engaging support bracket assembly.

In summary, another embodiment of the invention consists of an angular tombstone engaging support bracket assembly for supporting a personalized memorial display plaque in a display position above and in parallel register with a tombstone. An angular tombstone engaging support bracket assembly is provided with a front downwardly extending flat tombstone engaging portion. The angular tombstone engaging support bracket assembly is also provided with a rear downwardly extending flat tombstone engaging portion which is in spaced-apart parallel register with the front downwardly extending flat tombstone engaging portion so as to cooperate therewith to define a tombstone engaging recess therebetween. The rear downwardly extending flat tombstone engaging portion is provided with a threaded retainer screw hole longitudinal therethrough. The tombstone retainer screw hole operably is provided with a tombstone engaging retainer screw therethrough so as to selectively retainably engage the upper portion of a tombstone positioned within the tombstone engaging recess so as to secure the tombstone engaging support bracket assembly in its operative use position across the top of the tombstone upon which it is selectively mounted. The tombstone engaging support bracket is provided with an upwardly extending front memorial display plaque engaging flange. The tombstone engaging support bracket assembly is also provided with an upwardly extending rear memorial display plaque engaging flange in spaced-apart parallel register with the upwardly extending front memorial display plaque engaging flange so as to coact therewith to define a memorial display plaque engaging slot therebetween. The upwardly extending rear memorial display plaque engaging flange is provided with a memorial plaque threaded retainer screw hole longitudinally therethrough. The memorial display plaque threaded retainer screw hole is operably provided with a memorial display plaque retainer screw therethrough to selectively retainably engage the lower portion of a memorial display plaque selectively positioned within the memorial display plaque engaging slot so as to secure the memorial display plaque in its operative use display position upon said tombstone engaging support bracket assembly.

In summary, an expandable tombstone engaging support bracket assembly is provided for supporting a personalized memorial display plaque in a display position above and in parallel register with an oversize tombstone.

A tombstone engaging support bracket front main body portion, is provided with a downwardly extending flat tombstone engaging portion. The front main body portion is provided having an upwardly extending front memorial display plaque engaging flange and an upwardly extending rear memorial display plaque engaging flange in spaced-apart parallel register with the upwardly extending front memorial display plaque engaging flange so as to coact therewith to define a memorial display plaque engaging slot therebetween. The upwardly extending rear memorial display plaque engaging flange is provided with a memorial plaque threaded retainer screw hole longitudinally therethrough. The memorial display plaque threaded retainer screw hole is operably provided with a memorial display plaque retainer screw therethrough so as to selectively retainably engage the lower portion of a memorial display plaque selectively positioned within said memorial display plaque engaging slot so as to secure the memorial display plaque in its operative use display position. The front main body portion is provided with a threaded connector bolt stem receiving hole longitudinally extending into the inside end surface of the front main body portion.

A separate rear downwardly extending tombstone engaging portion is provided with an inward horizontally extending flange adapted to rest upon the upper horizontal portion of a tombstone in opposed spaced-apart parallel register with the front main body portion. The inward horizontally extending flange is provided with a connector bolt stem receiving hole therethrough in spaced-apart aligned register with the threaded connector bolt stem receiving hole provided in the front main body portion.

A threaded connector bolt is provided with a large head for selective engagement with the outer surface of the horizontally extending flange in aligned register with the connector bolt stem receiving hole provided therethrough. The connector bolt is provided with a threaded bolt stem wichi is adapted to extend freely through the bolt stem receiving hole provided through the horizontally extending flange into threaded operative engagement with the threaded bolt stem receiving hole provided in the main body portion. The connector bolt is selectively operable to coact with the front downwardly extending flat tombstone engaging portion and the separate rear downwardly extending tombstone engaging portion so as to clampably engage the upper portion of a tombstone positioned therebetween.

Various other modifications of the invention may be made without departing from the principle thereof. Each of the modifications is to be considered as included within the scope of the hereinafter appended claims, unless these claims, by their language, expressly provide otherwise.

I claim:

1. In a contoured tombstone engaging support bracket assembly for supporting a personalized memorial display plaque in a display position above and in parallel register with a tombstone comprising:

a contoured tombstone engaging support bracket assembly, said contoured tombstone engaging support bracket assembly having a front contoured downwardly extending tombstone engaging portion, said contoured tombstone engaging support bracket assembly having a rear contoured downwardly extending tombstone engaging portion in spaced-apart parallel register with said front contoured downwardly extending tombstone engaging portion so as to cooperate therewith to define a tombstone engaging recess therebetween, said rear contoured downwardly extending tombstone engaging portion having a recessed threaded tombstone retainer screw hole longitudinally therethrough, said recessed tombstone retainer screw hole operably provided with a tombstone engaging retainer screw therethrough to selectively retainably engage the upper portion of a tombstone positioned within said tombstone engaging recess so as to secure said contoured tombstone support bracket assembly in its operative use position across the top of the tombstone upon which it is mounted, said contoured tombstone engaging support bracket assembly having a centrally positioned forward contoured upper raised portion, said contoured tombstone engaging support bracket assembly having a centrally positioned rear contoured upper raised portion in spaced-apart parallel register with said forward contoured upper raised portion so as to cooperate therewith to define a transverse memorial display plaque engaging slot therebetween, said centrally positioned rear contoured upper raised portion having a recessed memorial display plaque retainer screw hole longitudinally therethrough, said recessed memorial display plaque retainer screw hole operably provided with a memorial display plaque retainer screw therethrough to selectively retainably engage the lower portion of a memorial display plaque selectively positioned within said transverse memorial display plaque engaging slot so as to secure the memorial display plaque in its operative use display position upon said contoured tombstone engaging support bracket assembly.

2. In an angular tombstone engaging support bracket assembly for supporting a personalized memorial display plaque in a display position above and in parallel register with a tombstone comprising:

an angular tombstone engaging support bracket assembly, said angular tombstone engaging support bracket assembly having a front downwardly extending flat tombstone engaging portion, said angular tombstone engaging support bracket assembly having a rear downwardly extending flat tombstone engaging portion in spaced-apart parallel register with said front downwardly extending flat tombstone engaging portion so as to cooperate therewith to define a tombstone engaging recess therebetween, said rear downwardly extending flat tombstone engaging portion having a threaded retainer screw hole longitudinal therethrough, said tombstone retainer screw hole operably provided with a tombstone engaging retainer screw therethrough to selectively retainably engage the upper portion of a tombstone positioned within said tombstone engaging recess so as to secure said tombstone engaging support bracket assembly in its operative use position across the top of the tombstone upon which it is selectively mounted, said tombstone engaging support bracket having an upwardly extending front memorial display plaque engaging flange, said tombstone engaging support bracket assembly having an upwardly extending rear memorial display plaque engaging flange in spaced-apart parallel register with said upwardly extending front memorial display plaque engaging flange so as to coact therewith to define a memorial display plaque engaging slot therebetween, said upwardly extending rear memorial display plaque engaging flange having a memorial plaque threaded retainer screw hole longitudinally therethrough, said memorial display plaque threaded retainer screw hole operably provided with a memorial display plaque retainer screw therethrough to selectively retainably engage the lower portion of a memorial display plaque selectively positioned within said memorial display plaque engaging slot so as to secure the memorial display plaque in its operative use display position upon said tombstone engaging support bracket assembly.

3. In an expandable tombstone engaging support bracket assembly for supporting a personalized memorial display plaque in a display position above and in parallel register with an oversize tombstone comprising:

(a) a tombstone engaging support bracket front main body portion, said front main body portion having a downwardly extending flat tombstone engaging portion, said front main body portion having an upwardly extending front memorial display plaque engaging flange, said front main body portion having an upwardly extending rear memorial display plaque engaging flange in spaced-apart parallel register with said upwardly extending front memorial display plaque engaging flange so as to coact therewith to define a memorial display plaque engaging slot therebetween, said upwardly extending rear memorial display plaque engaging flange having a memorial plaque threaded retainer screw hole longitudinally therethrough, said memorial display plaque threaded retainer screw hole operably provided with a memorial display plaque retainer screw therethrough to selectively retainably engage the lower portion of a memorial display plaque selectively positioned within said memorial display plaque engaging slot so as to secure the memorial display plaque in its operative use display position, said front main body portion having a threaded connector bolt stem receiving hole longitudinally extending into the inside end surface of said front main body portion;

(b) a separate rear downwardly extending tombstone engaging portion having an inward horizontally extending flange adapted to rest upon the upper horizontal portion of a tombstone in opposed spaced-apart parallel register with said front main body portion, said inward horizontally extending flange having a connector bolt stem receiving hole therethrough in spaced-apart aligned register with said threaded connector bolt stem receiving hole provided in said front main body portion;

(c) a threaded connector bolt, said connector bolt having a large head for selective engagement with the outer surface of said horizontally extending flange in aligned register with said connector bolt stem receiving hole provided therethrough, said connector bolt having a threaded bolt stem, said threaded bolt stem adapted to extend freely through said bolt stem receiving hole provided through said horizontally extending flange into threaded operative engagement with said threaded bolt stem receiving hole provided in said main body portion, said connector bolt selectively operable to coact with said front downwardly extending flat tombstone engaging portion and said separate rear downwardly extending tombstone engaging portion so as to clampably engage the upper portion of a tombstone positioned therebetween.

* * * * *